US008344979B2

(12) United States Patent
Liao et al.

(10) Patent No.: US 8,344,979 B2
(45) Date of Patent: Jan. 1, 2013

(54) METHOD AND APPARATUS FOR OVER-DRIVING LIQUID CRYSTAL DISPLAY

(75) Inventors: Mu-Shan Liao, Changhua County (TW); Tung-Hsin Lan, Taipei (TW); Hung-Chun Li, Taoyuan County (TW)

(73) Assignee: Chunghwa Picture Tubes., Ltd., Taoyuan (TW)

( * ) Notice: Subject to any disclaimer, the term of this patent is extended or adjusted under 35 U.S.C. 154(b) by 551 days.

(21) Appl. No.: 12/638,406

(22) Filed: Dec. 15, 2009

(65) Prior Publication Data

US 2011/0063332 A1 Mar. 17, 2011

(30) Foreign Application Priority Data

Sep. 15, 2009 (TW) ..... 98131085 A

(51) Int. Cl.
*G09G 3/36* (2006.01)
*G09G 5/10* (2006.01)

(52) U.S. Cl. ..... 345/89; 345/690; 345/204

(58) Field of Classification Search ..... None
See application file for complete search history.

(56) References Cited

U.S. PATENT DOCUMENTS

| | | | | |
|---|---|---|---|---|
| 2005/0249000 | A1 | 11/2005 | Kwack et al. | |
| 2008/0013126 | A1 * | 1/2008 | Tseng et al. | 358/3.01 |
| 2008/0204482 | A1 | 8/2008 | Kim | |
| 2009/0267930 | A1 * | 10/2009 | Sumi | 345/211 |
| 2010/0020276 | A1 * | 1/2010 | Jepsen | 349/106 |
| 2011/0199347 | A1 * | 8/2011 | Tsai et al. | 345/204 |

FOREIGN PATENT DOCUMENTS

| | | |
|---|---|---|
| TW | I270045 | 8/2004 |
| TW | I267044 | 3/2005 |

* cited by examiner

*Primary Examiner* — Andrew L Sniezek
(74) *Attorney, Agent, or Firm* — Morris Manning & Martin LLP; Tim Tingkang Xia, Esq.

(57) ABSTRACT

A method and an apparatus for over-driving a liquid crystal display (LCD) are provided, which are suitable for compensating a gray level brightness of the LCD. The method includes the following steps. Firstly, a data buffer unit outputs a current frame data. Then, the current frame data is stored into a frame memory unit, and the frame memory unit outputs a previous frame data. Next, several look-up tables (LUTs) are searched for a driving voltage in a corresponding LUT according to the current frame data and the previous frame data. Afterward, a position scanning unit receives the current frame data to determine a current position. Finally, a multiplexer outputs the corresponding driving voltage at the current position. Thus, a display panel has the same gray level brightness in upper, middle, and lower portions thereof, thereby avoiding ghosting.

10 Claims, 9 Drawing Sheets

METHOD AND APPARATUS FOR OVER-DRIVING LIQUID CRYSTAL DISPLAY

CROSS-REFERENCE TO RELATED APPLICATION

This application claims the benefit of Taiwan Patent Application No. 098131085, filed on Sep. 15, 2009, which is hereby incorporated by reference for all purposes as if fully set forth herein.

BACKGROUND OF THE INVENTION

1. Field of Invention

The present invention relates to a method and an apparatus for driving a liquid crystal display (LCD), and more particularly to a method and an apparatus for driving an LCD by using different over-driving look-up tables (LUTs) to determine different display positions.

2. Related Art

In a stereoscopic viewing method of a display apparatus, different contents are displayed to the left eye and the right eye of a person. In particular, the stereoscopic viewing method requires for presenting different images to the left eye and the right eye of the person. In a special stereoscopic viewing method, that is, a time-sequential stereoscopic viewing method, images for the left eye and the right eye are presented alternately.

In order to ensure full stereoscopic viewing, alternating shutter glasses are typically used. After wearing the alternating shutter glasses, a user is enabled to view images on the left with his/her left eye at appropriate time, and view images on the right with his/her right eye at appropriate time.

FIG. 1 is a timing diagram of a conventional alternating shutter glasses in use. When a display apparatus collocating with the alternating shutter glasses is an LCD, a frame rate of the display apparatus must be increased from conventional 60 Hz to 120 Hz, and a vertical blanking interval VBI must be increased. Right-eye frame data R is written to a right-eye portion RE of the alternating shutter glasses S, left-eye frame data L is written to a left-eye portion LE of the alternating shutter glasses S, and the left-eye portion LE is turned on during a vertical blanking interval VBI. The operations are sequentially performed, such that images are transmitted to the brain through the human eyes (left and right eyes), and then combined into a stereoscopic image.

FIG. 2 is a graph showing a relation between a driving voltage and a gray level brightness and a display position in a conventional over-driving method. FIG. 3A is a graphical diagram of a picture presented on a display panel of an LCD. FIG. 3B is a corresponding timing diagram illustrating the timing for writing data to the left eye and the right eye. In a common conventional over-driving method used to accelerate the liquid crystal reaction, for upper data P1 of a display panel P of an LCD, reaction time RT1 taken for respectively writing current frame data F(n) and next frame data F(n+1) to the left-eye portion and the right-eye portion of the alternating shutter glasses S (see FIG. 1) is long (see FIG. 3B), thus resulting in over-shooting, in which the driving voltage is D, and the gray level brightness (curve) is G1. For lower data P3 of the panel, reaction time RT2 taken for respectively writing the current frame data F(n) and the next frame data F(n+1) to the left-eye portion and the right-eye portion of the alternating shutter glasses S (see FIG. 1) is short (see FIG. 3B), thus resulting in under-shooting, in which the driving voltage is also D, and the gray level brightness (curve) is G3. For middle data P2 of the panel, a normal liquid crystal reaction takes place, in which the driving voltage is also D, and the gray level brightness (curve) is G2. When the left-eye portion (or the right-eye portion) of the alternating shutter glasses S is turned on, the driving voltage is D, and G1>G3>G2 (see FIG. 2). Due to the difference between the gray level brightness G1, G2, and G3, poor image quality occurs, that is, ghosting and blurring occur when the display panel P undergoes an optical reaction (see FIG. 3A).

SUMMARY OF THE INVENTION

Accordingly, the present invention is directed to a method and an apparatus for over-driving a liquid crystal display (LCD), in which different LUTs are searched according to different display positions to obtain corresponding over-driving voltages for over-driving the display positions, so as to obtain a required brightness in each region, thereby avoiding ghosting and blurring in the display process.

To achieve the above objectives, the present invention provides a method for over-driving a liquid crystal display (LCD), for compensating a gray level brightness of the LCD, the method comprising: outputting a current frame data by a data buffer unit; storing the current frame data into a frame memory unit, and outputting a previous frame data by the frame memory unit; searching several look-up tables (LUTs) for a driving voltage in a corresponding LUT according to the current frame data and the previous frame data; receiving the current frame data by a position scanning unit to determine a current position; and outputting the driving voltage by a multiplexer at the current position.

In the method for over-driving an LCD, the LCD has a frame refresh rate of 120 Hz.

In the method for over-driving an LCD, the LCD has N horizontal scan lines, and the step of receiving the current frame data by the position scanning unit to determine the current position comprises: dividing the N horizontal scan lines into at least two regions; up-converting a data enable (DE) signal; starting a sequential counter to count and scan the N horizontal scan lines; when the counting and scanning operation is performed on one region of the at least two regions, determining by the position scanning unit that the current position is the region of the at least two regions; and when the counting and scanning operation is performed on another region of the at least two regions, determining by the position scanning unit that the current position is the other region.

In the method for over-driving an LCD, the at least two regions comprise an upper region, a middle region, and a lower region.

In the method for over-driving an LCD, it further comprises controlling the frame memory unit by a control unit, and the control unit controls the frame memory unit to read and write the current frame data and an address thereof.

To achieve the above objectives, the present invention provides an apparatus for over-driving a liquid crystal display (LCD), for compensating a gray level brightness of the LCD, the apparatus comprising: a data buffer unit, for outputting current frame data; a frame memory unit, for storing the current frame data, and outputting previous frame data; several look-up tables (LUTs), for being searched for a driving voltage in a corresponding LUT according to the current frame data and the previous frame data; a position scanning unit, for receiving the current frame data to determine a current position; and a multiplexer, for outputting the driving voltage at the current position.

In the apparatus for over-driving an LCD, the LCD has a frame refresh rate of 120 Hz.

In the apparatus for over-driving an LCD, it further comprising a sequential counter, wherein the LCD has N horizontal scan lines; the N horizontal scan lines are divided into at least two regions; when a data enable (DE) signal is up-converted, the sequential counter is started to count and scan the N horizontal scan lines; when the counting and scanning operation is performed on one region of the at least two regions, the position scanning unit determines that the current position is the region of the at least two regions; and when the counting and scanning operation is performed on another region of the at least two regions, the position scanning unit determines that the current position is the other region.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 4A:
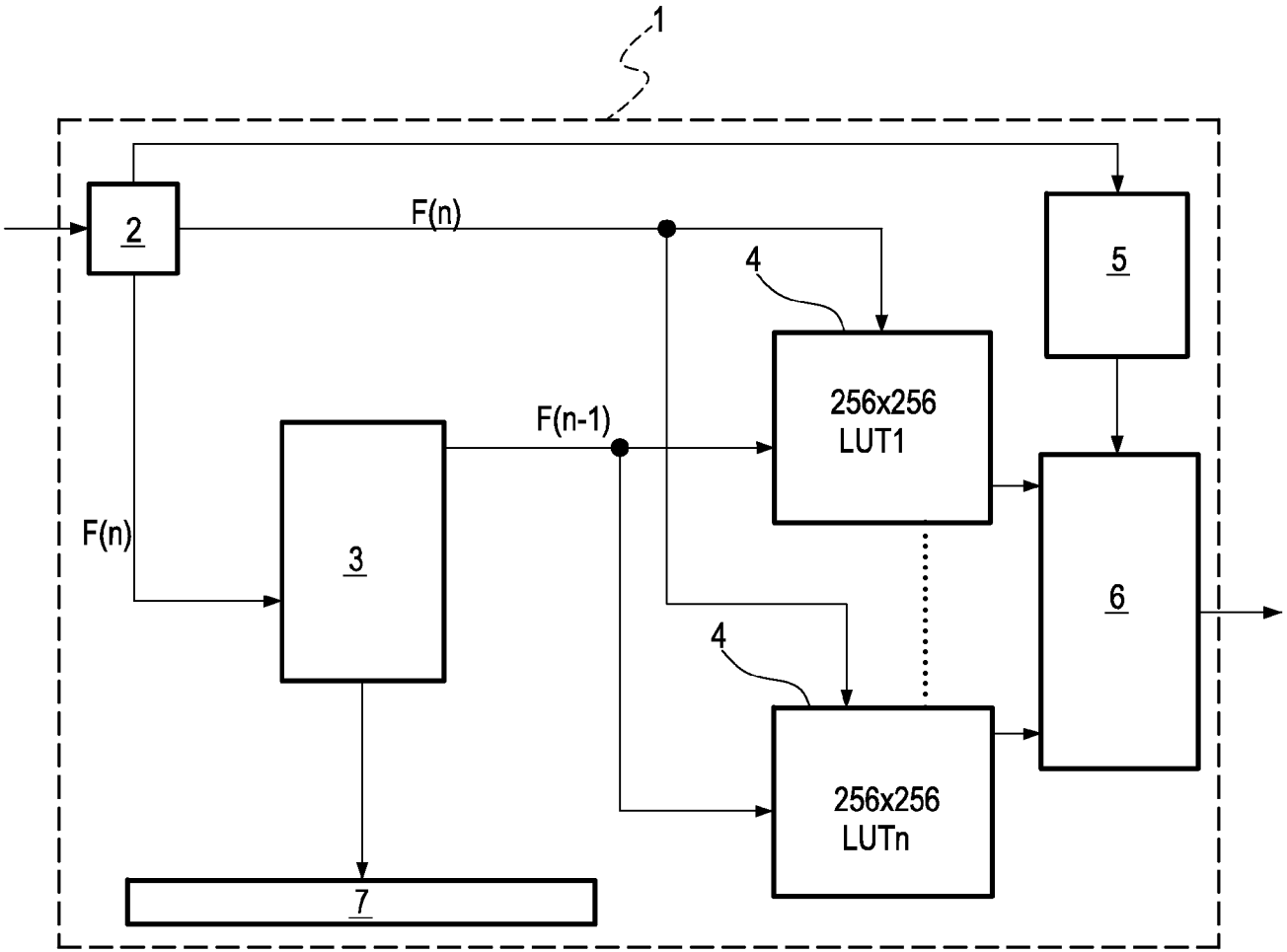
FIG. 4A is a block diagram of an over-driving apparatus according to an embodiment of the present invention.
Figure 4B:
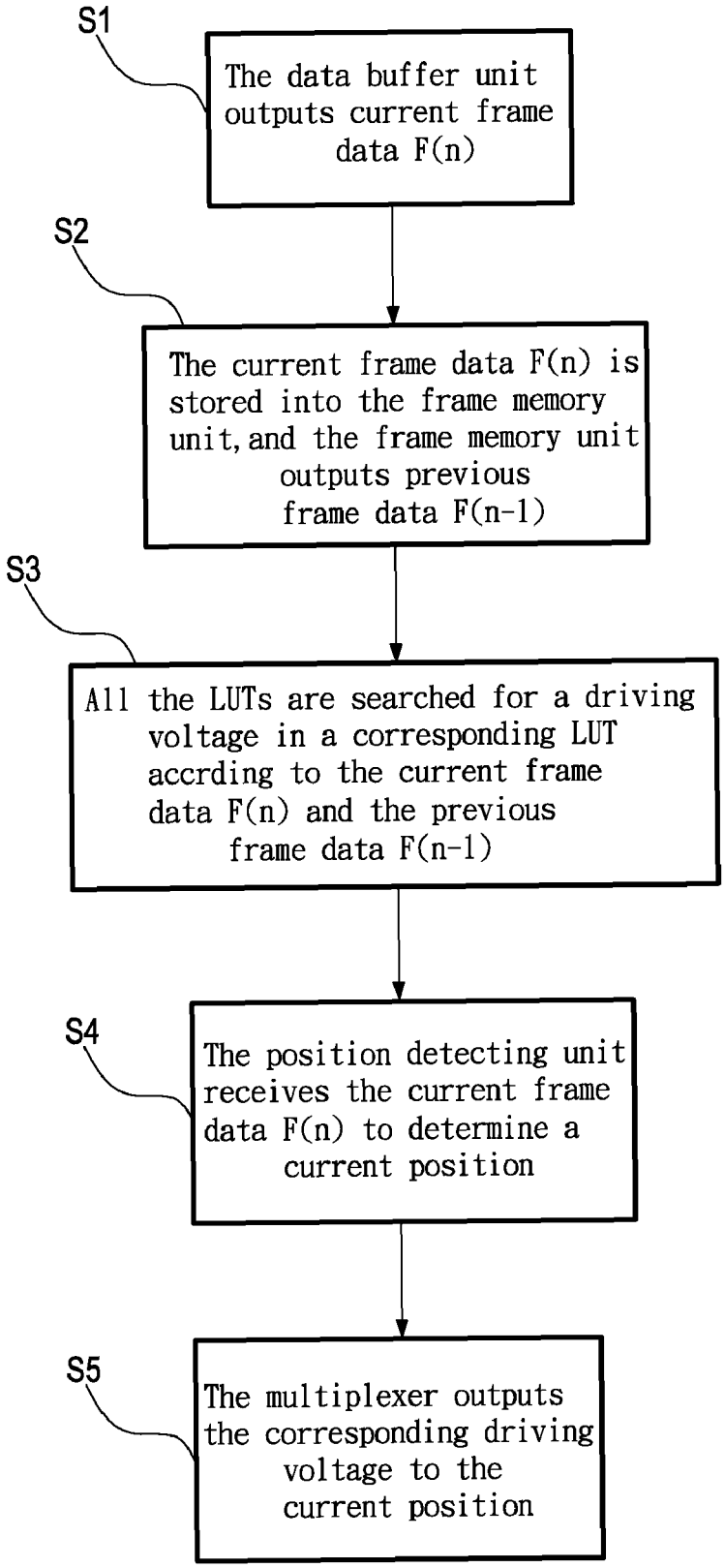
FIG. 4B is a flow chart of an over-driving method according to the embodiment of the present invention.

FIG. 4A is a block diagram of an over-driving apparatus according to an embodiment of the present invention. FIG. 4B is a flow chart of an over-driving method according to the embodiment of the present invention. Referring to FIGS. 4A and 4B, the over-driving apparatus 1 of this embodiment is suitable for compensating a gray level brightness of an LCD having N horizontal scan lines (to be detailed below), and includes a data buffer unit 2, a frame memory unit 3, several LUTs 4, a position scanning unit 5, a multiplexer 6, and a control unit 7.

Firstly, the data buffer unit 2 outputs current frame data F(n). Then, the current frame data F(n) is stored into the frame memory unit 3, and the frame memory unit 3 outputs previous frame data F(n−1). Next, the LUTs 4 are searched for a driving voltage D(256×256) in a corresponding LUT according to the current frame data F(n) and the previous frame data F(n−1). Afterward, the position scanning unit 5 receives the current frame data F(n) to determine a current position. Finally, the multiplexer 6 outputs the corresponding driving voltage D at the current position. Here, the LUTs 4 (including LUT1, . . . , LUTn as shown in FIG. 4A) and the driving voltages D thereof are stored in a static random access memory (SRAM) or a flash. In addition, the control unit 7 controls the frame memory unit 3 to read and write the current frame data F(n) and an address thereof.

The implementation of the over-driving apparatus 1 is described as follows.

In Step S1, the data buffer unit 2 outputs a current frame data F(n).

In Step S2, the current frame data F(n) is stored into the frame memory unit 3, and the frame memory unit 3 outputs a previous frame data F(n−1).

In Step S3, all the LUTs 4 are searched for a driving voltage D in a corresponding LUT according to the current frame data F(n) and the previous frame data F(n−1).

In Step S4, the position scanning unit 5 receives the current frame data F(n) to determine a current position.

In Step S5, the multiplexer 6 outputs the corresponding driving voltage D at the current position.

Here, the driving voltage D is corresponding to the gray level brightness on the display panel of the LCD.

Figure 7A:
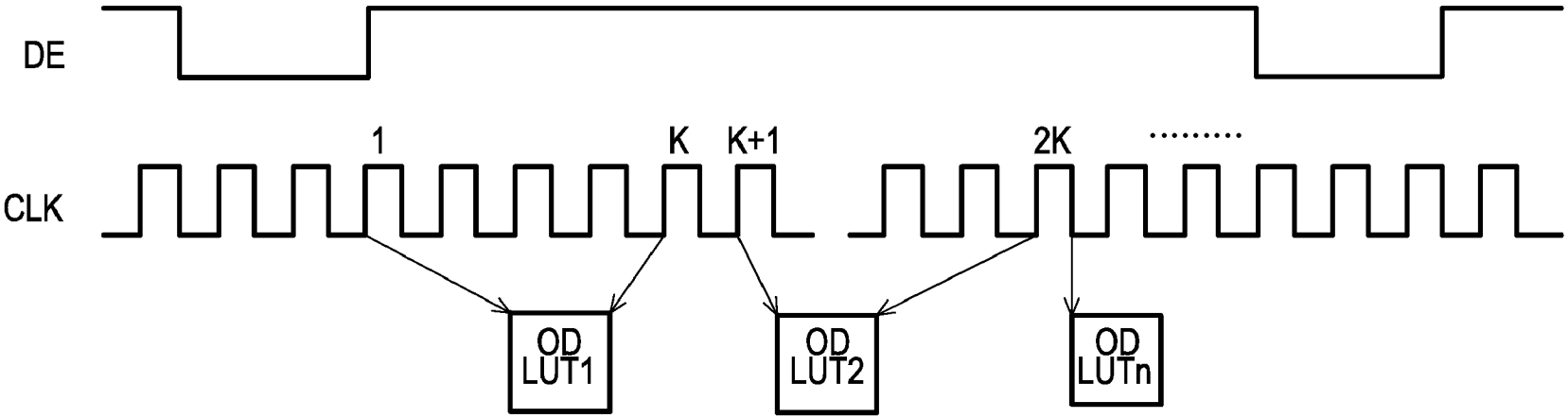
FIG. 7A is a timing diagram of an operation for determining a current position by a position scanning unit according to the embodiment of the present invention.
Figure 7B:
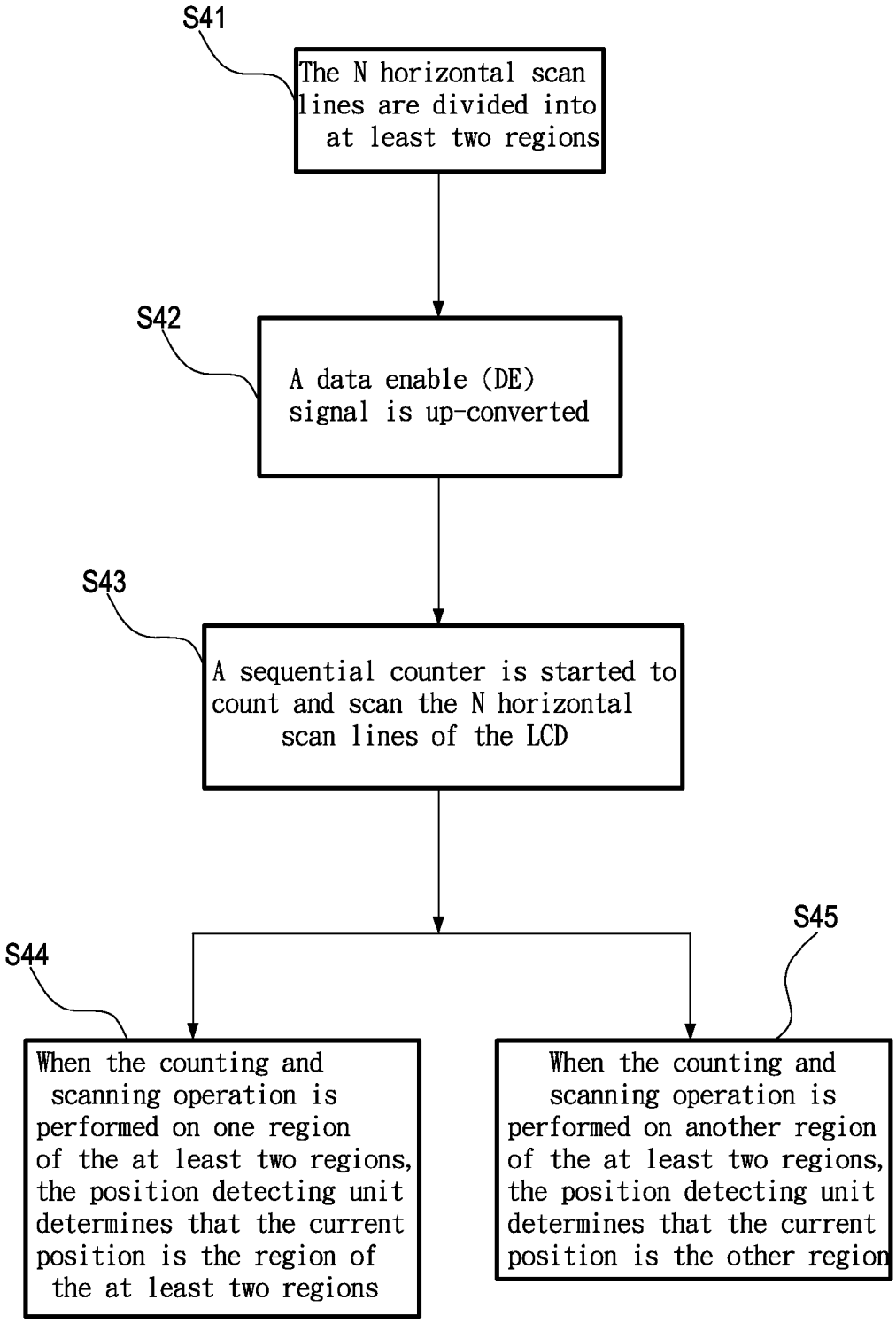
FIG. 7B is a flow chart of the operation for determining the current position by the position scanning unit according to the embodiment of the present invention.

FIG. 7A is a timing diagram of an operation for determining a current position by a position scanning unit according to the embodiment of the present invention. FIG. 7B is a flow chart of the operation for determining the current position by the position scanning unit according to the embodiment of the present invention. Referring to FIGS. 7A and 7B, the operation includes the following steps.

In Step S41, the N horizontal scan lines are divided into at least two regions.

In Step S42, a data enable (DE) signal is up-converted.

In Step S43, a sequential counter CLK is started to count and scan the N horizontal scan lines of the LCD.

In Step S44, when the counting and scanning operation is performed on one region of the at least two regions, the position scanning unit 5 determines that the current position is the region of the at least two regions.

In Step S45, when the counting and scanning operation is performed on another region of the at least two regions, the position scanning unit 5 determines that the current position is the other region.

In this embodiment, the at least two regions include an upper region, a middle region, and a lower region.

In particular, when the DE signal is up-converted, and the sequential counter CLK counts to 1~K, the position scanning unit 5 notifies the multiplexer 6 to use the first LUT 4 (LUT1) for output; when the sequential counter CLK counts to (K+1) ~2K, the position scanning unit 5 notifies the multiplexer 6 to use the second LUT 4 (LUT2) for output, and so on. Here, K is a positive integer and K is smaller than the number N of horizontal scan lines of the display panel.

For example, if the LCD panel has a resolution of 1920×1080 (M×N) and when the LCD panel is divided into an upper region, a middle region, and a lower region, this means that N=1080 and K=360 in each region. At this time, the upper region of the display panel is 1~360 (counting the horizontal scan lines from top to bottom), the middle region is 361~720, and the lower region is 721~1080. Therefore, the upper region (Horizontal Scan Lines 1~360) of the display panel is corresponding to the LUT1, the middle region (Horizontal Scan Lines 361~720) of the display panel is corresponding to the LUT2, and the $n^{th}$ LUT (LUTn) is deduced by analogy. Here, OD represents over-driving. It should be understood that, the LCD panel may be divided into a plurality of regions, and is not limited to the upper region, the middle region, and the lower region.

Figure 1:
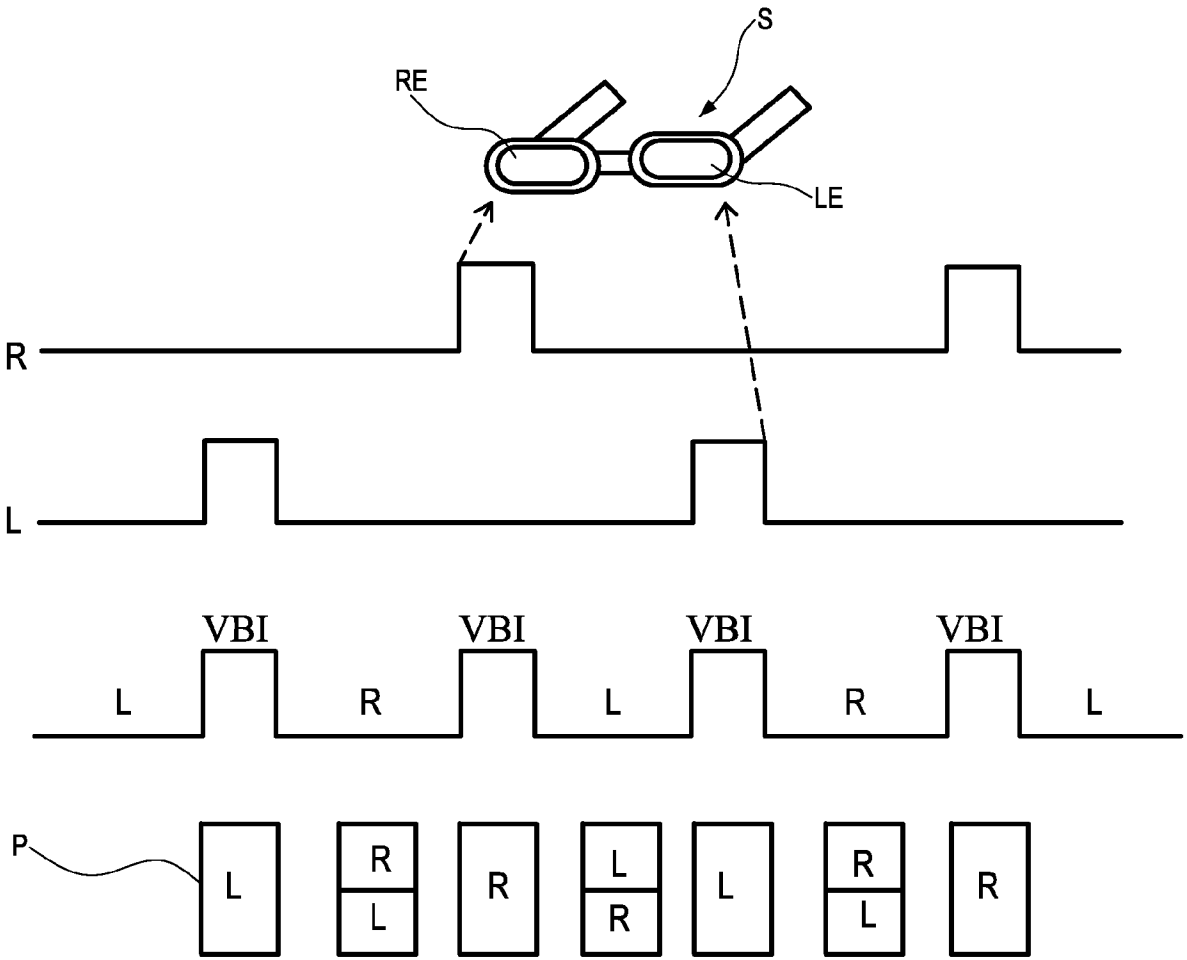
FIG. 1 (Prior Art)
FIG. 1 is a timing diagram of a conventional alternating shutter glasses in use.
Figure 2:
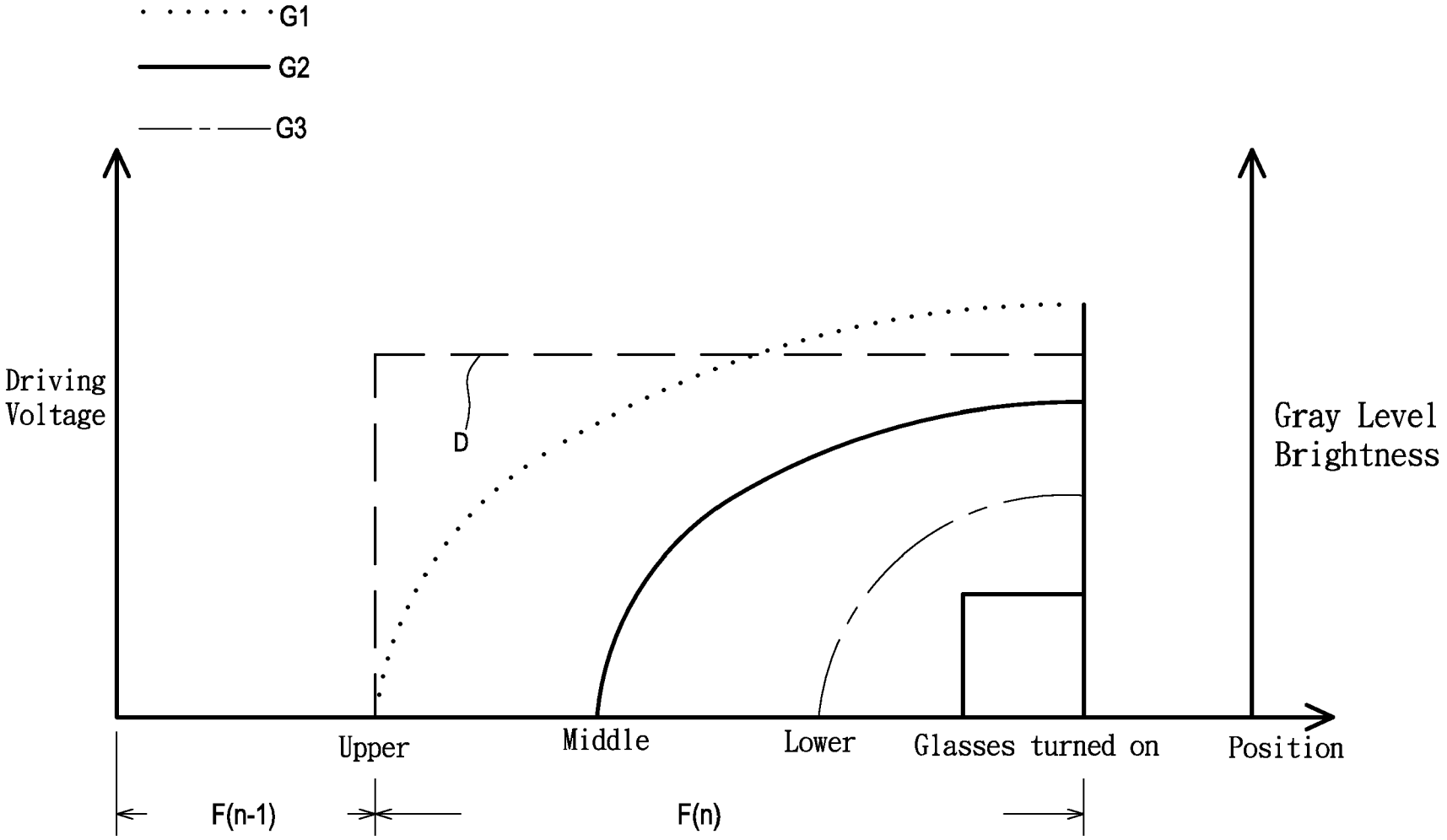
FIG. 2 (Prior Art)
FIG. 2 is a graph showing a relation between a driving voltage and a gray level brightness and a display position in a conventional over-driving method.
Figure 3A:
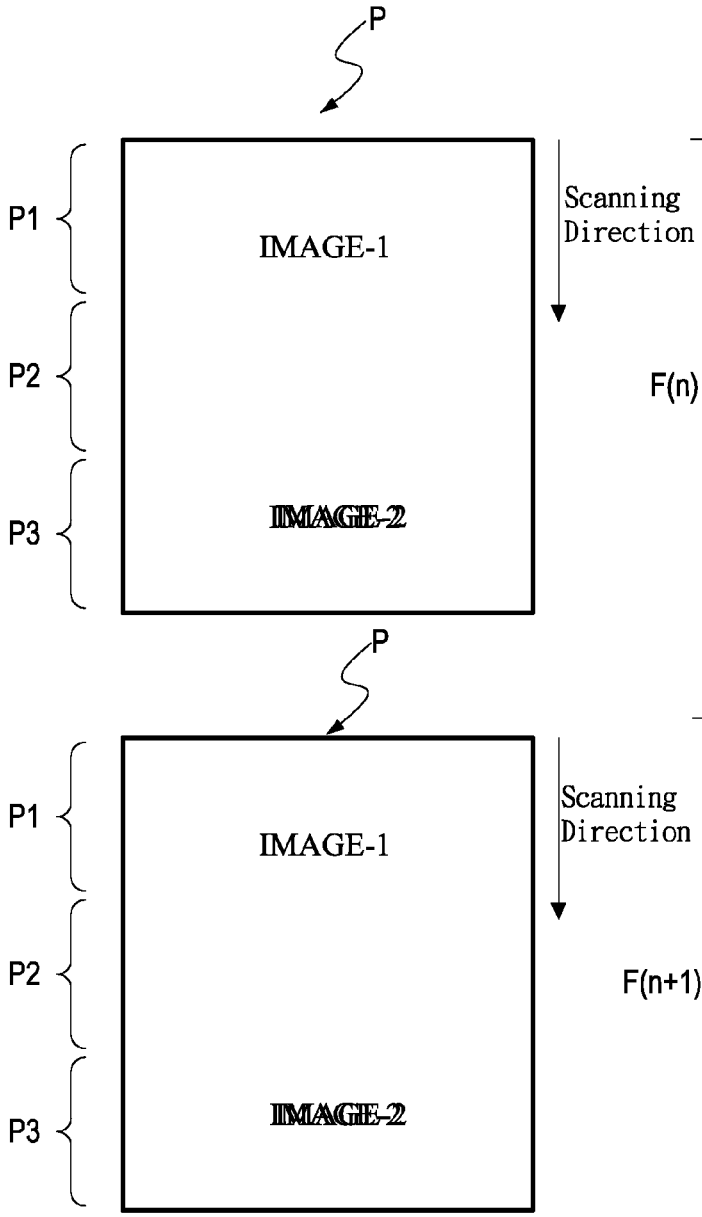
FIG. 3A (Prior Art)
FIG. 3A is a graphical diagram of a picture presented on a display panel of an LCD in the prior art.
Figure 3B:
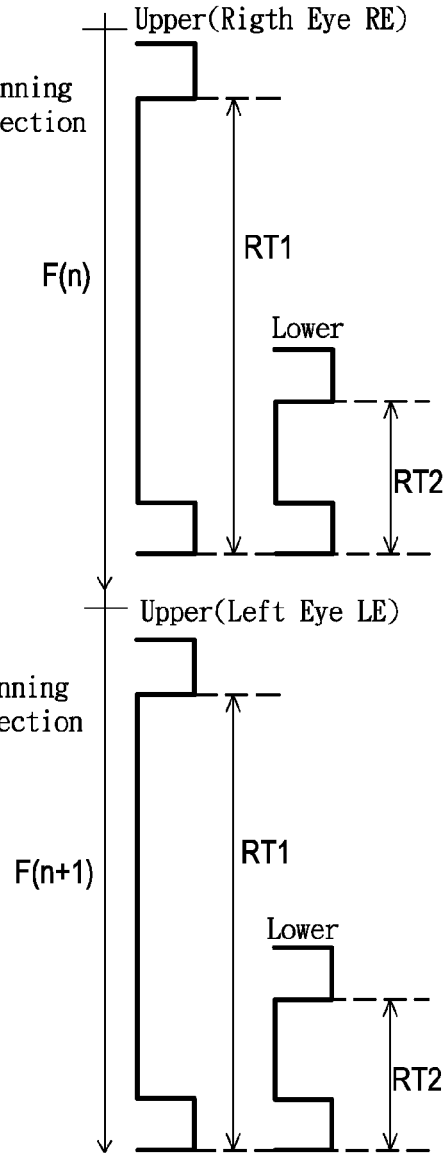
FIG. 3B (Prior Art)
FIG. 3B is a corresponding timing diagram illustrating the timing for writing data to the left eye and the right eye in the prior art.
Figure 5:
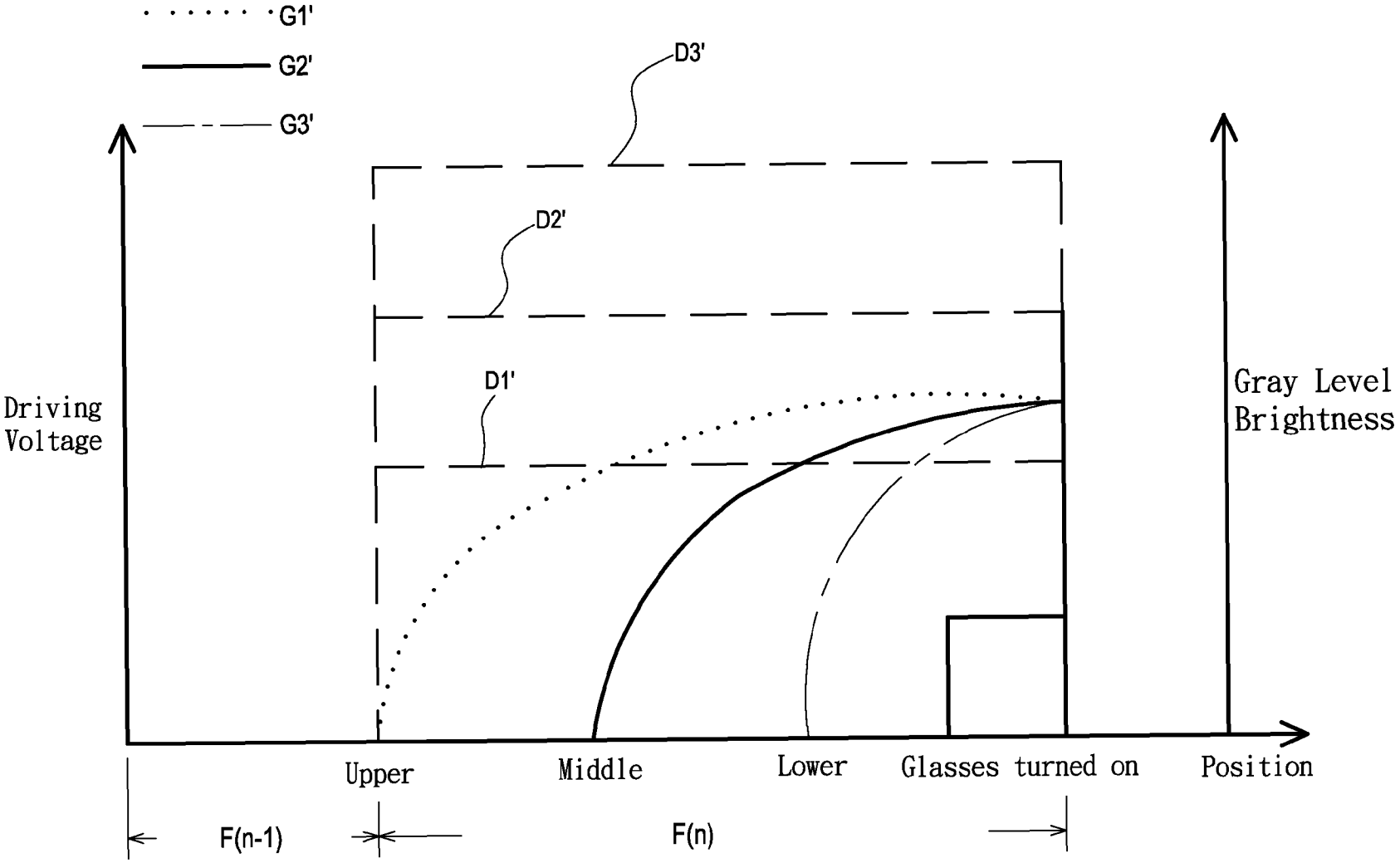
FIG. 5 is a graph showing a relation between a driving voltage and a gray level brightness and a display position in the method for over-driving an LCD according to the present invention.
Figure 6A:
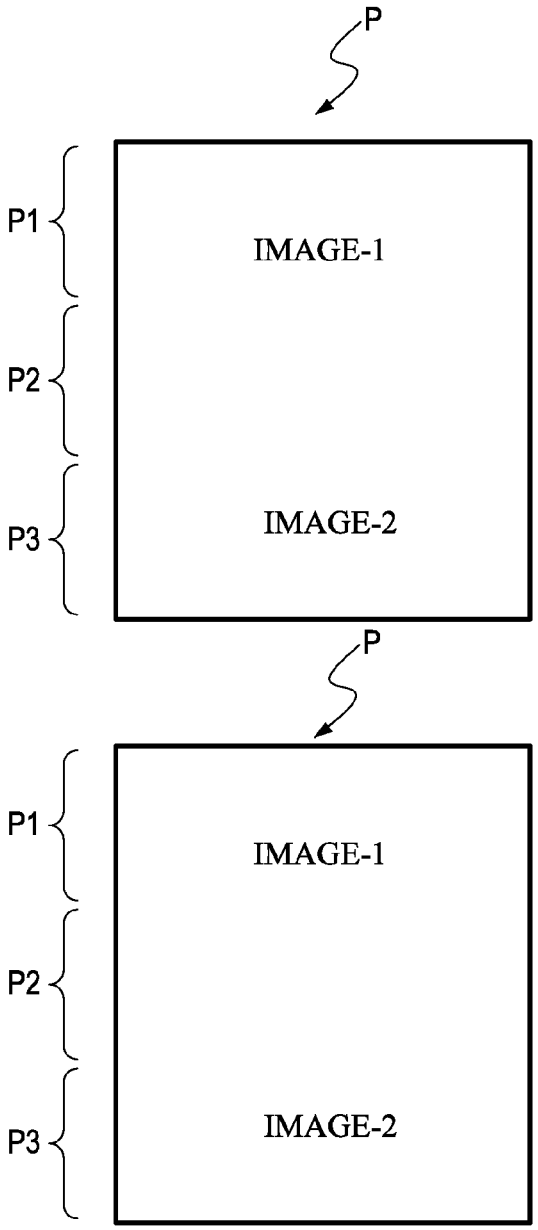
FIG. 6A is a graphical diagram of a picture presented on a display panel of the LCD according to the present invention.
Figure 6B:
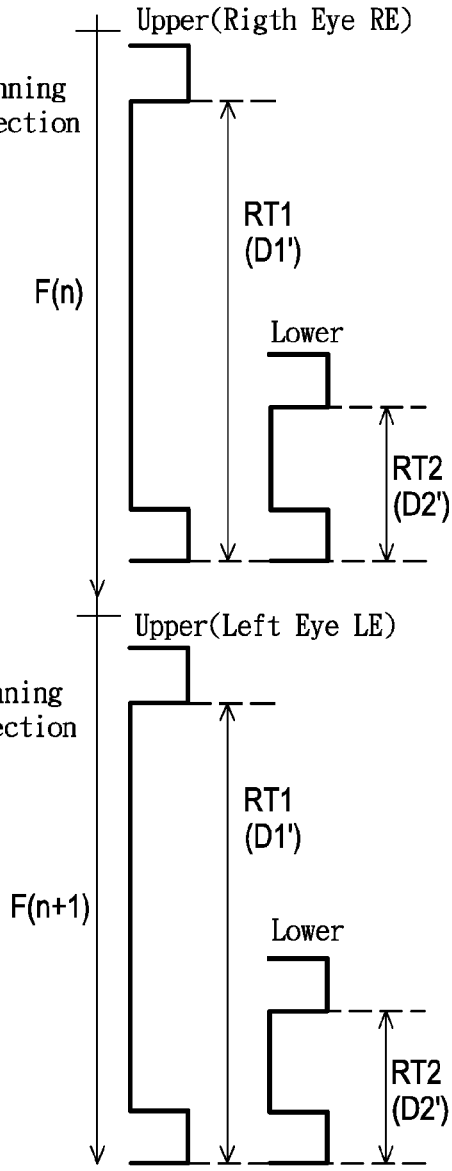
FIG. 6B is a corresponding timing diagram illustrating the timing for writing data to the left eye and the right eye according to the present invention.

FIG. 5 is a graph showing a relation between a driving voltage and a gray level brightness and a display position in the method for over-driving an LCD according to the present invention. FIG. 6A is a graphical diagram of a picture presented on a display panel of the LCD according to the present invention. FIG. 6B is a corresponding timing diagram illustrating the timing for writing data to the left eye and the right eye according to the present invention. As mentioned in the prior art, the gray level brightness of the middle data P2 is adjusted by using an over-driving LUT, so that the influence on the middle data P2 is less significant than that on the upper data P1 and the lower data P3. Therefore, in the following embodiment of the present invention, the upper data P1 and the lower data P3 that are significantly influenced are illustrated. Compared with the prior art, in the embodiment of the present invention, for the upper data P1 of the display panel P, reaction time RT1 taken for respectively writing current frame data F(n) and next frame data F(n+1) to the left-eye portion and the right-eye portion of the alternating shutter glasses S (see FIG. 1) is long (see FIG. 6B), thus resulting in over-shooting, so that the driving voltage D in the corresponding LUT 4 is low, so as to correct the reaction speed of liquid crystal, referring to the driving voltage D1' and the gray level brightness (curve) G1' as shown in FIG. 5. For the lower data P3 of the panel, reaction time RT2 taken for respectively writing current frame data F(n) and next frame data F(n+1) to the left-eye portion and the right-eye portion of the alternating shutter glasses S (see FIG. 1) is short (see FIG. 6B), thus resulting in under-shooting, so that the driving voltage D2' in the corresponding LUT 4 is high (that is, over-driving), so as to correct the reaction speed of liquid crystal, referring to the driving voltage D3' and the gray level brightness (curve) G3' as shown in FIG. 5. For the middle data P2 of the panel, a normal liquid crystal reaction takes place, in which the driving voltage is D2', and the gray level brightness (curve) is G2'. When the left-eye portion (or the right-eye portion) of the alternating shutter glasses S is turned on, D3'>D2'>D1' and G1'=G2'=G3' (see FIG. 5).

Since the current position is determined by scanning in the present invention, and the corresponding optimal LUT 4 is searched for the driving voltage D (D1', D2', D3'), so as to uniformly distribute the gray level brightness G1', G2', and G3', ghosting and blurring are avoided when the display panel P undergoes an optical reaction (see FIG. 6A).

Although the present invention is explained through preferred embodiments, the embodiments are not intended to limit the present invention. It should be noted that, various similar embodiments derived by persons skilled in the art without departing from the spirit of the present invention shall fall within the scope of the present invention.

What is claimed is:

1. A method for over-driving a liquid crystal display (LCD), for compensating a gray level brightness of the LCD, the method comprising:

outputting a current frame data by a data buffer unit;

storing the current frame data into a frame memory unit, and outputting a previous frame data by the frame memory unit;

searching several look-up tables (LUTs) for a driving voltage in a corresponding LUT according to the current frame data and the previous frame data;

receiving the current frame data by a position scanning unit to determine a current position; and outputting the driving voltage by a multiplexer at the current position,.

wherein the LCD has N horizontal scan lines, and the step of receiving the current frame data by the position scanning unit to determine the current position comprises:

dividing the N horizontal scan lines into at least two regions;

up-converting a data enable (DE) signal;

starting a sequential counter to count and scan the N horizontal scan lines;

when the counting and scanning operation is performed on one region of the at least two regions, determining by the position scanning unit that the current position is the region of the at least two regions; and when the counting and scanning operation is performed on another region of the at least two regions, determining by the position scanning unit that the current position is the other region.

2. The method for over-driving an LCD according to claim 1, wherein the LCD has a frame refresh rate of 120 Hz.

3. The method for over-driving an LCD according to claim 1, wherein the at least two regions comprise an upper region, a middle region, and a lower region.

4. The method for over-driving an LCD according to claim 1, further comprising: controlling the frame memory unit by a control unit.

5. The method for over-driving an LCD according to claim 4, wherein the control unit controls the frame memory unit to read and write the current frame data and an address thereof

6. An apparatus for over-driving a liquid crystal display (LCD), for compensating a gray level brightness of the LCD, the apparatus comprising:

a data buffer unit, for outputting a current frame data;

a frame memory unit, for storing the current frame data, and outputting a previous frame data;

several look-up tables (LUTs), for being searched for a driving voltage in a corresponding LUT according to the current frame data and the previous frame data;

a position scanning unit, for receiving the current frame data to determine a current position;

a multiplexer, for outputting the driving voltage at the current position; and a sequential counter, wherein the LCD has N horizontal scan lines; the N horizontal scan lines are divided into at least two regions; when a data enable (DE) signal is up-converted, the sequential counter is started to count and scan the N horizontal scan lines; when the counting and scanning operation is performed on one region of the at least two regions, the position scanning unit determines that the current position is the region of the at least two regions; and when the counting and scanning operation is performed on another region of the at least two regions, the position scanning unit determines that the current position is the other region.

7. The apparatus for over-driving an LCD according to claim 6, wherein the LCD has a frame refresh rate of 120 Hz.

8. The apparatus for over-driving an LCD according to claim 6, wherein the at least two regions comprise an upper region, a middle region, and a lower region.

9. The apparatus for over-driving an LCD according to claim 6, further comprising a control unit, for controlling the frame memory unit.

10. The apparatus for over-driving an LCD according to claim 9, wherein the control unit controls the frame memory unit to read and write the current frame data and an address thereof.

* * * * *